US007070689B2

(12) United States Patent
Thiery et al.

(10) Patent No.: US 7,070,689 B2
(45) Date of Patent: Jul. 4, 2006

(54) ACID DIP FOR ZINC-MANGANESE ALLOY ELECTRODEPOSITION

(75) Inventors: Lionel Thiery, Chichy (FR); Gianluigi Schiavon, Mogliano Veneto-Treviso (IT); Nicolas Pommier, Clichy (FR)

(73) Assignee: Coventya, Clichy (FR)

( * ) Notice: Subject to any disclaimer, the term of this patent is extended or adjusted under 35 U.S.C. 154(b) by 66 days.

(21) Appl. No.: 10/467,264

(22) PCT Filed: Feb. 6, 2002

(86) PCT No.: PCT/FR02/00459

§ 371 (c)(1),
(2), (4) Date: Aug. 4, 2003

(87) PCT Pub. No.: WO02/063071

PCT Pub. Date: Aug. 15, 2002

(65) Prior Publication Data

US 2004/0050712 A1 Mar. 18, 2004

(30) Foreign Application Priority Data

Feb. 6, 2001 (FR) ..... 01 01555

(51) Int. Cl.
*C25D 3/56* (2006.01)
*C23C 18/00* (2006.01)

(52) U.S. Cl. ..... 205/244; 205/238; 106/1.29

(58) Field of Classification Search ..... 106/1.29; 205/244, 238
See application file for complete search history.

(56) References Cited

U.S. PATENT DOCUMENTS

| | | | | |
|---|---|---|---|---|
| 4,898,652 | A | 2/1990 | Bammel et al. | 204/44.2 |
| 6,387,229 | B1 * | 5/2002 | Cornelius Verberne | 204/245 |

FOREIGN PATENT DOCUMENTS

| | | | |
|---|---|---|---|
| FR | 2762331 | A1 * | 10/1998 |
| GB | 2 351 503 | A | 1/2001 |
| JP | 57094590 | A | 6/1982 |
| JP | 03090591 | | 4/1991 |
| JP | 5065674 | A | 3/1993 |

* cited by examiner

*Primary Examiner*—Edna Wong
(74) *Attorney, Agent, or Firm*—Knobbe, Martens, Olson & Bear, L.L.P.

(57) ABSTRACT

The invention relates to a dip comprising an acid aqueous solution having no ammonium ion, fluoroborate ions or citrate ion and containing per liter: between 10 and 60 g of $Zn^{2+}$ ions and between 20 and 100 g of $Mn^{2+}$ ions. The invention is characterised in that it comprises a buffer agent that maintains the pH at a value of between 3 and 7, preferably between 4.5 and 6 or better still between 4.8 and 5.5, and another agent, different from the buffer agent, which is used to bring together the deposition potentials of couple $Zn/Zn^{2+}$ and couple $Mn/Mn^{2+}$. The inventive dip used to deposit a Zn and Mn alloy by electrolysis.

12 Claims, No Drawings

ACID DIP FOR ZINC-MANGANESE ALLOY ELECTRODEPOSITION

This application is the U.S. National Phase under 35 U.S.C. § 371 of International Application PCT/FR02/00459, filed Feb. 6, 2002, which was published in a language other than English which claims priority of FR 01 01555, filed Feb. 6, 2001 Each of the above applications are incorporated herein by reference in their entirety.

The present invention relates to an electrolysis bath composed of an acidic aqueous solution which makes it possible to deposit an alloy of zinc and of manganese, in particular on steel.

Deposits of zinc and of zinc alloys are increasingly used to slow down the appearance of red rust, corresponding to attack on steel. The zinc deposits therefore protect the steel by sacrificial protection. This protection is due to the low electrochemical potential of zinc ($E^o_{Zn^{2+}/Zn}$=−0.76 V/SHE) with respect to that of steel ($E^o_{Fe^{2+}/Fe}$=−0.44 V/SHE).

Considerable efforts have been made in order to create new zinc-based systems with corrosion resistances equal to or better than those obtained with pure zinc. Deposits of zinc alloys, such as Zn/Fe, Zn/Co, Zn/Ni and Zn/Mn, have thus been developed.

Zinc/manganese deposits have shown their superiority in comparison with other zinc alloys by their better corrosion resistance in a natural atmosphere. Surface analyses after exposure to natural corrosion have demonstrated the presence of a manganese oxide of the $\gamma$-$Mn_2O_3$ type which would act as passivation layer. This type of oxide would block the reduction of the oxygen and would consequently decrease the corrosion of the coating (Des alliages de zinc et de manganèse aptes au revêtement protecteur de plaques d'acier [Alloys of zinc and of manganese suitable for the protective coating of steel sheets]—Jacqueline Crousier—Matériaux & Techniques, 1999, No. 3–4).

The known processes for electrolytic depositions of zinc/manganese are composed of an acidic aqueous solution either based on sodium citrate or based on ammonium chloride.

Patent WO 91/17884 discloses a process which makes it possible to codeposit zinc and manganese using an acid bath based on sodium citrate. This compound (sodium citrate) is added to the electrolytic solution in order to shift the electrochemical potential for deposition of zinc towards that of manganese (the least noble metal). This electrolytic bath operates at a temperature of 50° C. and at a pH of 5.4.

According to the studies of Mrs. Crousier, there are disadvantages to the use of the citrate compound since, with this type of bath, it is impossible to obtain alloys comprising more than 12% of manganese while retaining a suitable efficiency. Furthermore, this type of bath is very sensitive to pH variations and its stability over time is limited since the appearance of fungi and of crystalline products is observed.

Patent FR 2 762 331 discloses a method which makes it possible to codeposit zinc and manganese with less restrictive requirements than those mentioned above for the citrate-based bath. A bath based on ammonium chloride was therefore chosen. A significant amount of ammonium chloride is used in order to increase the electrical conductivity of the electrolytic medium and in order to bring closer the electrochemical potentials of zinc and manganese and thus to make possible their codeposition. The ammonium ion is necessary to obtain deposition of zinc and of manganese (Free University of Brussels Thesis—1990—Lenge Masangu Mpoyo). This type of bath does not make it possible either, if it is desired to retain a suitable efficiency, to prepare alloys comprising more than 12% of manganese. However, the use of ammonium ions results in additional costs related to the treatment of the aqueous waste liquors. This is because, during the treatment of such a bath, the use of an alkaline agent alone is not sufficient to precipitate the metal hydroxides as the metal/ammonium complex is very stable. Consequently, the treatment of the baths comprising ammonium ions requires the deployment of a specific treatment in order to separate the metal ions from the ammonium ions. This treatment thus results in an additional cost.

The document GB 2 351 503 reiterates the disadvantages related to the use of acid baths based on ammonium chloride or fluoroborate. This is because these baths are undesirable from an environmental viewpoint and do not make it possible to obtain deposits comprising more than 9% of manganese. According to this document, the replacement of ammonium chloride by a chloride-based alkali metal salt, such as sodium chloride or potassium chloride, does not make it possible either to obtain deposits with sufficient concentrations of manganese in the deposit. On the other hand, the use of complexing agents, such as tartaric acid or gluconic acid, makes it possible to obtain deposits having high concentrations of manganese in the deposit.

This type of bath exhibits the disadvantage of operating at a pH of between 6.3 and 6.9, which requires the addition of sodium hydroxide to the bath. The zinc and manganese ions are not stable at this pH, that is to say that they exist in the form of zinc and manganese hydroxide precipitates. Consequently, to prevent the formation of these entities, it is necessary to complex the zinc ions and the manganese ions with complexing agents, such as citric acid or tartaric acid. Furthermore, there is a risk that the local increase in pH which occurs during the reduction of the zinc and manganese will lead to the formation of zinc and manganese hydroxides. This phenomenon is accentuated if the operation is carried out at a very slightly acidic pH, that is to say of the order of 6.3 to 6.9. Consequently, a large amount of buffering agent, of the order of 50 to 70 g/l of boric acid, is necessary in order to avoid the formation of zinc and manganese hydroxides. There is a risk that the use of this type of bath, that is to say operating at a very slightly acidic pH with large amounts of boric acid, will lead to the formation of zinc borate. This salt tends to be deposited on the walls of vessels, anode bags and anodes, resulting in a degree of passivity of these devices.

The present invention is targeted at a stable electrolysis bath composed of an acidic aqueous solution which makes it possible to obtain a deposit of zinc and of manganese having a good content of manganese and a good efficiency, without having to carry out a specific treatment of the aqueous waste liquors. This acid bath therefore does not require the presence of complexing agents and makes it possible to use smaller amounts of boric acid than those used in the document GB 2 351 503.

A subject-matter of the invention is a bath composed of an acidic aqueous solution devoid of ammonium ion, of fluoroborate ion and of citrate ion and comprising, per liter, from 10 to 60 g of $Zn^{2+}$ ions, from 20 to 100 g of $Mn^{2+}$ ions, characterized in that it comprises a buffering agent which maintains the pH at a value of between 4.0 and 6.0 and preferably between 4.5 and 6 and another agent, separate from the buffering agent, which makes it possible to bring closer the potentials for deposition of zinc and of manganese.

The invention is also targeted at a process for the electrolytic deposition of an alloy of zinc and of manganese using the bath according to the invention.

In the invention, use is made of an acidic aqueous solution devoid of ammonium ion, of fluoroborate ion and of citrate ion comprising:

Zinc ions at a concentration of approximately 10 to 60 g/l. The zinc ion can be present in the form of a soluble salt, such as zinc sulphate or zinc chloride.

Manganese ions at a concentration of approximately 20 to 100 g/l. The manganese ion can be present in the form of a soluble salt, such as manganese sulphate or manganese acetate or manganese chloride.

A conducting salt, in particular an alkali metal salt, such as sodium chloride, potassium chloride, sodium sulphate or potassium sulphate. Its concentration in the electrolytic bath is preferably from 100 to 250 g/l.

A buffering agent in order to control the pH. This is because, in the prior baths, the buffering effect was obtained by the citrate, tartrate or gluconate ions and the ammonium ions. This buffering agent can be boric acid and its concentration is of the order of 5 to 40 g/l. Other buffers can be used, such as hydrogen phthalate, dihydrogenphosphate and acetate buffers. The aim is to have a sufficient amount of hydronium ions to have a pH of between 4.8 and 5.5.

At least one agent for bringing closer the potentials or addition agent, in order to shift the electrochemical potential of zinc towards that of manganese and thus to make possible the codeposition of zinc and manganese. This role was played by the ammonium ions and the citrate ions in the other baths. This is because the simultaneous deposition of two metals is difficult, indeed even impossible, starting from electrolytes comprising the simple ions of the metals to be deposited. As the electrochemical potentials of the couples are different ($E^{o}_{Zn^{2+}/Zn}$=−0.76 V/SHE and $E^{o}_{Mn^{2+}/Mn}$=−1.18 V/SHE), the polarization curves, which are far apart, show that it is difficult to find a potential region where codeposition will take place.

The potentials of the two redox systems can be brought closer by complexing the metal ions. The complexing modifies the electrochemical potential of each of the couples and makes it possible to bring closer the polarization curves.

It is then possible, by complexing, to codeposit the zinc and the manganese by electrolysis.

These addition agents are the compounds having the following general formula:

$$R_1—(CH_2—CH_2—O)_n—R_2$$

$$0<n<25$$

$R_1$=aryloxy group, in particular phenoxy or naphthoxy group, aryloxyalkoxy group, in particular phenoxyalkoxy or naphthoxyalkoxy group, where the alkoxy part of the aryloxyalkoxy radical has from 1 to 6 carbon atoms, alkylaryl group, in particular alkylphenyl or alkylnaphthyl group, where the alkyl part of the alkylaryl radical has from 1 to 12 carbon atoms, alkylaryloxy group, in particular alkylphenoxy or alkylnaphthoxy group, or alkylaryloxyalkoxy group, in particular alkylphenoxyalkoxy or alkylnaphthoxyalkoxy group, $R_2$=—H, $—(CH_2)_m—SO_3^-M^+$, where m=0 to 5, $—(CH_2)_z—PO_3^{2-}M^+_2$, where z=0 to 2, or $—CH_2—COO^-M^+$, where $M^+=Na^+$, $K^+$ or $NH_4^+$, or aryl, in particular phenyl or naphthyl (the linear or branched alkyl groups preferably having from 1 to 6 carbon atoms).

Preferably, $R_1$ is aryloxyalkoxy, in particular phenoxyalkoxy or naphthoxyalkoxy.

They are preferably used at a concentration of between 0.5 and 10 g/l.

These addition agents also make it possible to dissolve the brightening compounds which are also present in the bath.

It is also possible to add a synergy agent which makes it possible to further increase the amount of manganese deposited. These synergy agents are the compounds having the following general formula:

$$R_3\text{-}(Ph)_p\text{-}R_4$$

$$p=1 \text{ or } 2$$

$R_3$=—H or a linear or branched alkyl group having up to 6 carbon atoms, $R_4=(CH_2)_q—SO_3^-M^+$, with q=0 to 5, or $—COO^-M^+$ with $M^+=Na^+$, $K^+$ or $NH_4^+$.

They are preferably used at a concentration of between 0.1 and 10 g/l.

A brightening agent is optionally added to the electrolysis bath in order to obtain a bright deposit and in order to improve the codeposition of the alloyed metal, the manganese. These brightening agents are compounds which have the general formula:

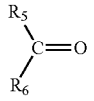

$R_5$=—H, $—CH_3$, aryl group, in particular phenyl, alkylphenyl or alkenylphenyl, such as: $—C_6H_5$, $CH_3—C_6H_4—$, $CH_3—CH_2—C_6H_4—$ or $—CH=CH—C_6H_5$, or naphthyl group, $R_6$=—H or alkyl, such as $—CH_3$, $—CH_2—CH_3$ or $—CH_2—CH_2—CH_3$ (the linear or branched alkyl and alkenyl groups preferably having from 1 to 6 carbon atoms).

They are preferably used at a concentration from approximately 0.1 to 1.5 g/l.

It has now been realized that the citrate or ammonium ions previously played two different roles. By entrusting, according to the invention, the role of buffering agent and the role of agent for bringing closer the potentials to different compounds, a constraint on the choice of the agent for bringing closer the potentials is removed and it is now possible to use, as such, a complexing agent which is less troublesome in the discharges than those to which it was necessary to resort.

A bath for the deposition of zinc and of manganese is formed in the following way:

For 1 Liter of Bath:

The following compounds are dissolved in the order shown and with stirring. During the preparation of the bath, the temperature should be approximately 35° C. to promote the dissolution of the salts.

Water

Conducting salt (NaCl, KCl, $Na_2SO_4$, $K_2SO_4$)

Buffering agent ($H_3BO_3$)

$ZnCl_2$, $ZnSO_4$ $MnCl_2$, $MnSO_4$ or $Mn(CH_3COO)_2$

Addition agents and synergy agents

Brightening agents.

The composition of the bath and the operating parameters are summarized in the following table:

| | Wide | Preferred | Recommended |
|---|---|---|---|
| Composition of the bath* | | | |
| Zn | 10–60 | 20–50 | 30–35 |
| Mn | 20–100 | 30–80 | 30–35 |
| Conducting salt | 150–300 | 170–270 | 200–220 |
| Buffering agent | 5–40 | 15–35 | 20–30 |
| Composition of the base* | | | |
| Addition agents $R_1—(CH_2—CH_2—O)_n—R_2$ | 0.4–25 | 0.5–15 | 4–10 |
| Synergy agents $R_3—(Ph)_p—R_4$ | 0.1–15 | 0.5–10 | 4–8 |
| Composition of the brightening agent* $R_5—(C=O)—R_6$ | 0.01–5 | 0.01–1.5 | 0.01–1 |
| Operating conditions | | | |
| pH | 4.0–6.0 | 4.5–6.0 | 4.8–5.5 |
| Temperature (° C.) | 15–40 | 18–32 | 20–25 |
| Current density ($A/dm^2$) | 0.05–10 | 0.1–5 | 0.3–2 |

*All the compositions given are in g/l

EXAMPLES

The following examples were carried out in an electrochemical cell composed of a 5 liter parallelepipedal glass vessel in which are immersed a steel cathode and, on either side of the latter, two zinc anodes.

Deposition is carried out at 1.5 $A/dm^2$ for 30 minutes.

The deposit is subsequently analysed by X-ray fluorescence or by dissolution of the deposit in dilute hydrochloric acid and quantitative determination by atomic absorption spectrometry to confirm the presence of manganese in the deposit.

Comparative Example 1

Example 1.1

| | |
|---|---|
| Zinc chloride | 60 g/l |
| Manganese chloride monohydrate | 60 g/l |
| Ammonium chloride | 250 g/l |
| Boric acid | 25 g/l |

This composition makes it possible to codeposit zinc and manganese but it exhibits the disadvantage of using ammonium ions.

This is because the treatment of the effluents from baths formulated from Example 1.1 (bath comprising 250 g/l of ammonium chloride, i.e. 84 g/l of $NH_4^+$ ions) requires particular attention.

The ammonium ion strongly complexes metal ions, such as the $Ni^{2+}$ and $Cu^{2+}$ ions (ions which can be present in a surface treatment line), which are therefore not precipitated in the form of metal hydroxide during the neutralization/precipitation process.

It is therefore necessary to very extensively dilute in order to come within the discharge standards for these metal ions; indeed even, in the case of the presence of metal ions, to treat the effluent on a specific resin in order to separate the metal ion from the ammonium ion. Thus, the ammonium ion exhibits a twofold toxicity related, first, to the discharge of the ammonium ion and, secondly, to the discharge of the associated metal ion.

For all these reasons, baths comprising ammonium ions are undesirable.

In addition to the risk related to a discharge comprising excessively high concentrations of metal ions, the discharge of the ammonium ion in itself constitutes pollution of the environment.

Example 1.2

| | |
|---|---|
| Zinc chloride | 60 g/l |
| Manganese chloride monohydrate | x |
| Potassium chloride | 240 g/l |
| Boric acid | 25 g/l |

In this example, the concentration of manganese chloride x was varied from 60 g/l to 150 g/l.

In all cases:

the element manganese is not found by analysis, that is to say that only zinc is deposited, the bath is stable for several months, that is to say that bacterial growth is not observed in the bath, nor is crystalline precipitation.

Example 1.3

| | |
|---|---|
| Zinc chloride | 60 g/l |
| Manganese chloride monohydrate | 60 g/l |
| Potassium chloride | y g/l |
| Boric acid | 25 g/l |

In this example, the concentration of potassium chloride y was varied from 75 g/l to 150 g/l.

In all cases:

the element manganese is not found by analysis, that is to say that only zinc is deposited, the bath is stable for several months, that is to say that bacterial growth is not observed in the bath, nor is crystalline precipitation.

Example 2

(According to the Invention)

| | |
|---|---|
| Zinc chloride | 60 g/l |
| Manganese chloride monohydrate | 60 g/l |
| Potassium chloride | 240 g/l |
| Boric acid | 25 g/l |

In this example, the addition agent sulphated ethoxylated β-naphthol, defined by the following formula:

$$C_{10}H_7—O—[CH_2—CH_2—O]_8—SO_3^-Na^+$$

was added.

This compound is sold by Sabo under the name of Sabosol NFE-8.

Its concentration in the bath was varied from 0.5 g/l to 10 g/l.

In all cases:

the deposit comprises manganese, that is to say that deposition of zinc and of manganese has been carried out. Furthermore, the amount of manganese in the deposit increases with the concentration of addition agent, the bath is stable for several months, that is to say that bacterial growth is not observed in the bath, nor is crystalline precipitation.

Example 3

(According to the Invention)

| | |
|---|---|
| Zinc chloride | 60 g/l |
| Manganese chloride monohydrate | 60 g/l |
| Potassium chloride | 240 g/l |
| Boric acid | 25 g/l |

In this example, the addition agent comprising β-naphthol defined by the following formula:

$$C_{10}H_7—O—[CH_2—CH\ (—CH_3)—O]_n—[CH_2—CH_2—O]_m—CH_2—CH_2—CH_2—SO_3^-K^+$$

was added.

This compound is sold by Raschig GmbH, Ludwigshafen, Germany, under the name of Ralufon NAPE 14–90.

Its concentration in the bath was varied from 0.5 g/l to 10 g/l.

In all cases:

the deposit comprises manganese, that is to say that deposition of zinc and of manganese has been carried out. Furthermore, the amount of manganese in the deposit increases with the concentration of addition agent, the bath is stable for several months, that is to say that bacterial growth is not observed in the bath, nor is crystalline precipitation.

Example 4

(According to the Invention)

| | |
|---|---|
| Zinc chloride | 60 g/l |
| Manganese chloride monohydrate | 60 g/l |
| Potassium chloride | 240 g/l |
| Boric acid | 25 g/l |

In this example, the addition agent comprising β-naphthol defined by the following formula:

$$C_{10}H_7—O—[CH_2—CH_2—O]_{24}—H$$

was added.

This compound is sold by BASF under the name of Lugalvan BNO 24.

Its concentration in the bath was varied from 0.5 g/l to 10 g/l.

In all cases:

the deposit comprises manganese, that is to say that deposition of zinc and of manganese has been carried out. Furthermore, the amount of manganese in the deposit increases with the concentration of addition agent, the bath is stable for several months, that is to say that bacterial growth is not observed in the bath, nor is crystalline precipitation.

Example 5

(According to the Invention)

| | |
|---|---|
| Zinc chloride | 60 g/l |
| Manganese chloride monohydrate | 60 g/l |
| Potassium chloride | 240 g/l |
| Boric acid | 25 g/l |

In this example, the addition agent defined by the following name:

Sodium diisopropylnaphthalenesulphonate was added.

This compound is sold by Cytec Industries Inc. under the name of Aerosol OS (West Paterson, N.J., USA).

Its concentration in the bath was varied from 0.5 g/l to 5 g/l.

In all cases:

the deposit comprises manganese, that is to say that deposition of zinc and of manganese has been carried out. Furthermore, the amount of manganese in the deposit increases with the concentration of addition agent, the bath is stable for several months, that is to say that bacterial growth is not observed in the bath, nor is crystalline precipitation.

The same results were obtained using Petro BA from Witco, which is a sodium alkylnaphthalenesulphonate.

Example 6

(Comparative)

| | |
|---|---|
| Zinc chloride | 60 g/l |
| Manganese chloride monohydrate | 60 g/l |
| Potassium chloride | 240 g/l |
| Boric acid | 25 g/l |

In this example, the nonylphenolated addition agent defined by the following formula:

$$HO—(CH_2—CH_2—O)_n—H$$

where n=12 was added.

Its concentration in the bath was varied from 0.5 g/l to 5 g/l.

In all cases:

the deposit does not comprise manganese.

Example 7

(Comparative)

| | |
|---|---|
| Zinc chloride | 60 g/l |
| Manganese chloride monohydrate | 60 g/l |
| Potassium chloride | 240 g/l |
| Boric acid | 25 g/l |

In this example, the nonylphenolated addition agent defined by the following formula:

$$H_{19}C_9—C_6H_4—O—(CH_2—CH_2—O)_n—CH_2—CH_2—CH_2—SO_3^-K^+$$

where n=9 was added.

This compound is sold by Raschig under the name of Ralufon N 9.

Its concentration in the bath was varied from 0.1 g/l to 3 g/l.

In all cases:

the deposit does not comprise manganese.

Example 8

(Comparative)

| | |
|---|---|
| Zinc chloride | 60 g/l |
| Manganese chloride monohydrate | 60 g/l |
| Potassium chloride | 240 g/l |
| Boric acid | 25 g/l |

In this example, the addition agent defined by the following formula:

$$C_6H_5—COO^-Na^+$$

was added.

Its concentration in the bath was varied from 0.1 g/l to 8 g/l.

In all cases:

the deposit does not comprise manganese.

Example 9

(Comparative)

| | |
|---|---|
| Zinc chloride | 60 g/l |
| Manganese chloride monohydrate | 60 g/l |
| Potassium chloride | 240 g/l |
| Boric acid | 25 g/l |

In this example, the addition agent defined by the following formula:

$$C_3H_7—Ph—SO_3^-Na^+$$

was added.

Its concentration in the bath was varied from 0.1 g/l to 8 g/l.

In all cases:

the deposit does not comprise manganese.

Example 10

| | |
|---|---|
| Zinc chloride | 60 g/l |
| Manganese chloride monohydrate | 60 g/l |
| Potassium chloride | 240 g/l |
| Boric acid | 25 g/l |

In this example, the addition agents defined by the following formulae were added:

$$H_{19}C_9—C_6H_4—O—(CH_2—CH_2—O)_n—CH_2—CH_2—CH_2—SO_3^-K^+$$

where n=9

Its concentration in the bath is 0.2 g/l.

$$HO—(CH_2—CH_2—O)_n—H$$

where n=12

Its concentration in the bath is 3 g/l.

$$C_{10}H_7—O—[CH_2—CH(—CH_3)—O]_n—[CH_2—CH_2—O]_m—CH_2—CH_2—CH_2—SO_3^-K^+$$

Its concentration in the bath is 8 g/l.

The deposit comprises manganese, that is to say that deposition of zinc and of manganese has been carried out, the bath is stable for several months, that is to say that bacterial growth is not observed in the bath, nor is crystalline precipitation.

Example 11

| | |
|---|---|
| Zinc chloride | 60 g/l |
| Manganese chloride monohydrate | 60 g/l |
| Potassium chloride | 240 g/l |
| Boric acid | 25 g/l |

In this example, the addition and synergy agents defined by the following formulae were added:

$$C_6H_5—COO^-Na^+$$

Its concentration in the bath is 3 g/l.

$$C_3H_7\text{-}Ph\text{-}SO_3^-Na^+$$

Its concentration in the bath is 3 g/l.

$$C_{10}H_7—O—[CH_2—CH(—CH_3)—O]_n—[CH_2—CH_2—O]_m—CH_2—CH_2—CH_2—SO_3^-K^+$$

Its concentration in the bath is 8 g/l.

The deposit comprises manganese, that is to say that deposition of zinc and of manganese has been carried out. Furthermore, it is surprising to find that the deposit comprises even more manganese than in Examples 2 and 3, where the bath comprised only the agent for bringing closer the potentials. Furthermore, the use of the synergy agents alone does not make it possible to codeposit zinc and manganese (Examples 8 and 9). Thus, the use of synergy agents in a bath comprising the addition agents makes it possible: to obtain deposits having even more manganese.

The bath is stable for several months, that is to say that bacterial growth is not observed in the bath, nor is crystalline precipitation.

Example 12

| | |
|---|---|
| Zinc chloride | 60 g/l |
| Manganese chloride monohydrate | 60 g/l |
| Potassium chloride | 240 g/l |
| Boric acid | 25 g/l |

In this example, the following were added:

an addition agent defined by the following formula:

$$C_{10}H_7—O—[CH_2—CH(—CH_3)—O]_n—[CH_2—CH_2—O]_m—CH_2—CH_2—CH_2—SO_3^-K^+$$

The concentration in the bath is 8 g/l.

and a brightening agent defined by the following formula:

$$C_6H_5—CH=CH—(C=O)—CH_3$$

Its concentration in the bath was varied from 0.01 g/l to 0.5 g/l.

In all cases:

the deposit comprises manganese, that is to say that deposition of zinc and manganese has been carried out, the manganese being present in a greater content than if only the addition agent is used. This synergy effect is unexpected.

the deposit is very bright, the bath is stable for several months, that is to say that bacterial growth is not observed in the bath, nor is crystalline precipitation.

The invention claimed is:

1. An acidic aqueous solution devoid of ammonium ion, of fluoroborate ion and of citrate ion and comprising, per liter, from 10 to 60 g of $Zn^{2+}$ ions, from 20 to 100 g of $Mn^{2+}$ ions, a buffering agent, and an agent for bringing closer the potentials for deposition of a $Zn/Zn^{2+}$ couple and of a $Mn/Mn^{2+}$ couple that is a compound of formula $$R_1—(CH_2—CH_2—O)_n—R_2$$

$$0<n<25$$

wherein $R_1$=aryloxy group, aryloxyalkoxy group, alkylaryl group, alkylaryloxy group, or alkylaryloxyalkoxy group, $R_2$=-H, $—(CH_2)_m–SO_3^-M^+$, where m =0 to 5, $—(CH_2)_2—PO_3^{2-}M^+_2$, -where z =0 to 2, or $—CH_2—COO^-M^+$, where $M^+=Na^+$, $K^+$or $NH_4^+$or aryl, present in a concentration of 0.5 to 15 g/l.

2. An acidic aqueous solution according to claim 1, characterized in that $R_1$ is a phenoxyalkoxy or a naphthoxyalkoxy radical.

3. An acidic aqueous solution according to claim 1, characterized in that the alkoxy part of the aryloxyalkoxy group has 1 to 6 carbon atoms.

4. An acidic aqueous solution according to claim 1, further comprising a synergy agent, characterized in that the synergy agent is a compound of formula:

$$R_3—(Ph)_{p—R4}$$

$$p = 1 \text{ or } 2$$

$R_3$=—H or a linear or branched alkyl group having up to 6 carbon atoms, $R_4=(CH_2)_q\ SO_3^-M^+$, with q =0 to 5, or $—COO^-M^+$ with $M^+=Na^+$, $K^+$or $NH_4^+$.

5. An acidic aqueous solution according to claim 4, characterized in that the synergy agent is present in a proportion of 0.5 to 10 g/l.

6. An acidic aqueous solution according to claim 1, characterized in that it further comprises a brightening agent of formula

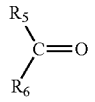

$R_5$=—H, $—CH_3$, or aryl group, $R_6$ =—H or alkyl, which is present in a proportion of 0.01 to 1 g/l.

7. An acidic aqueous solution according to claim 6, wherein $R_5$ represents an aryl group selected from the group consisting of phenyl, alkylphenyl, alkenylphenyl, and naphthyl group.

8. An acidic aqueous solution according to claim 1, wherein $R_1$ represents a phenoxy, naphthoxy, phenoxyalkoxy, naphthoxyalkoxy, alkylphenyl, alkylnaphthyl, alkylphenoxy, alkylnaphthoxy, alkylphenoxyalkoxy or alkylnaphthoxyalkoxy group.

9. An acidic aqueous solution according to claim 1, wherein the alkyl part of the alkylaryl group has from 1 to 12 carbon atoms.

10. An acidic aqueous solution according to claim 1, characterized in that it further comprises a conducting alkali metal salt.

11. A method for the electrolytic deposition of an alloy of zinc and of manganese, characterized in that it comprises using the acidic aqueous solution according to claim 1 and carrying out the electrolytic deposition at a temperature of 15 to 40° C. and at a current density of 0.05 to 10 A/din$^2$.

12. An acidic aqueous solution according to claim 1, characterized in that the aryl is selected from the group consisting of phenyl and naphthyl.

* * * * *